United States Patent [19]

Lass

[11] 4,197,624

[45] Apr. 15, 1980

[54] CORNER ROLLER TOOL FOR TAPING DRY WALL

[75] Inventor: Harold M. Lass, San Jose, Calif.

[73] Assignee: Corban Industries, Inc., San Jose, Calif.

[21] Appl. No.: 953,203

[22] Filed: Oct. 20, 1978

[51] Int. Cl.[2] ..... B05C 1/08; B21B 7/02; B44C 7/00

[52] U.S. Cl. ..... 29/110.5; 29/122; 156/465; 156/574; 156/579

[58] Field of Search ..... 156/574, 577, 579, 465; 29/110.5, 121.6, 121.1, 122

[56] References Cited

U.S. PATENT DOCUMENTS

| | | | |
|---|---|---|---|
| 2,533,209 | 12/1950 | Ames | 156/574 |
| 2,994,899 | 8/1961 | Moilanen | 29/122 |
| 3,717,899 | 2/1973 | Gardner | 29/122 |
| 3,880,701 | 4/1975 | Moree | 156/579 |

*Primary Examiner*—Douglas J. Drummond
*Attorney, Agent, or Firm*—Harry E. Aine; Harvey G. Lowhurst

[57] ABSTRACT

In a corner roller tool for rolling mud laden applied tape into a corner dry wall seam, a pair of tandem rollers are provided for rolling the creased tape into the corner seam and for squeezing out excess mud from beneath the tape. The rollers each comprise a wheel having a tread portion of generally V-shaped radial cross section. The included angle $\theta$ between the opposed faces of the V-shaped tread portion is approximately 90° for pressing the tape into firm engagement with the side walls of the corner seam. The corner roller wheels are carried from a frame which is pivotably coupled to a elongated handle. The handle is pivotable in at least two orthogonal directions to facilitate rolling of the tape into the corner seam when the operator can not face directly into the seam. The corner roller wheel are free to move laterally on their respective axles to facilitate tracking of imperfect seams. The included angle between the tread face portions of the two wheels are preferably larger than 90° for one wheel and less than 90° for the other to facilitate pressing of the tape into imperfect right angle corner seams.

5 Claims, 4 Drawing Figures

CORNER ROLLER TOOL FOR TAPING DRY WALL

BACKGROUND OF THE INVENTION

The present invention relates in general to tools for taping seams between sections of dry wall as used in the building construction trade and, more particularly, an improved corner roller tool for rolling the applied tape into firm engagement with the intersecting sheets of dry wall at the corner seam.

DESCRIPTION OF THE PRIOR ART

Heretofore, corner roller tools for rolling applied dry wall tape into a corner seam have included a set of four roller wheels, each of generally cylindrical configuration. The wheels were arranged in two tandem pairs, each pair of roller wheels being disposed with axes of revolution perpendicular to each other and generally parallel to the respective walls at the corner seam. The axis of revolution of each roller wheel was laterally directed of the longitudinal axis of the seam to be taped.

The problem with this prior art corner roller tool is that it includes a relatively large number of rollers, each including its own axle, thereby making the tool relatively complicated and difficult to clean, in as much as the dry wall cement, which is being squeezed out from underneath the tape by the tool, tends to accumulate in the axles of the wheels.

SUMMARY OF THE PRESENT INVENTION

The principal object of the present invention is the provision of an improved corner rolling tool for pressing applied cement laden dry wall tape into a corner seam and for squeezing out from underneath the applied tape the excess dry wall cement or mud for ease of finishing.

In one feature of the present invention, the corner roller tool includes a pair of corner roller wheels disposed in tandem such that the wheels track one behind the other and with the tread portions of the wheels having a generally V-shaped radial cross section with the included angle $\theta$ between the opposed faces of the tread portions being between 80° and 110° for pressing the tape into firm engagement with the dry wall at the corner seams, whereby a relatively simple cornering tool is provided.

In another feature of the present invention, the included angle $\theta$ between the opposed faces of the tread portions of one wheel is greater than that of the other to accommodate imperfections in the angle of intersection of the sheets of dry wall at the corner seam being taped.

In another feature of the present invention, each of the corner rolling wheels is free to travel on its respective axle in a direction along its respective axis of rotation to facilitate tracking of the wheels along an imperfect seam.

Other features and advantages of the present invention will become apparent upon a perusal of the following specification taken in connection with the accompanying drawings wherein:

DESCRIPTION OF THE PREFERRED EMBODIMENTS

Figure 1:
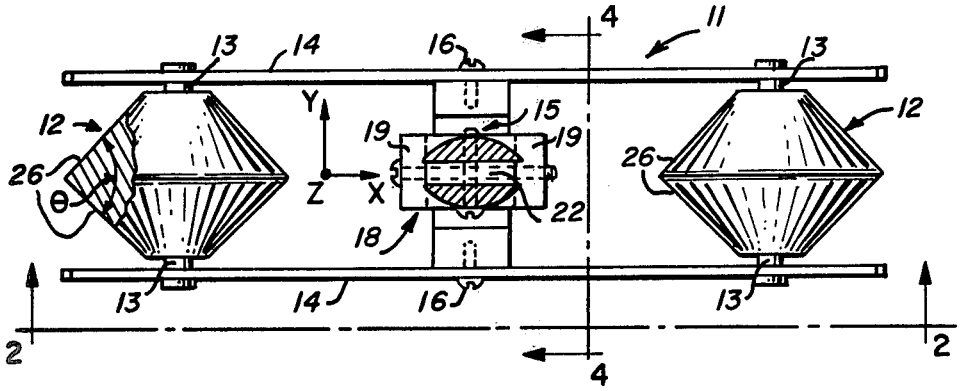
FIG. 1 is a plan view of a corner roller tool incorporating features of the present invention.
Figure 2:
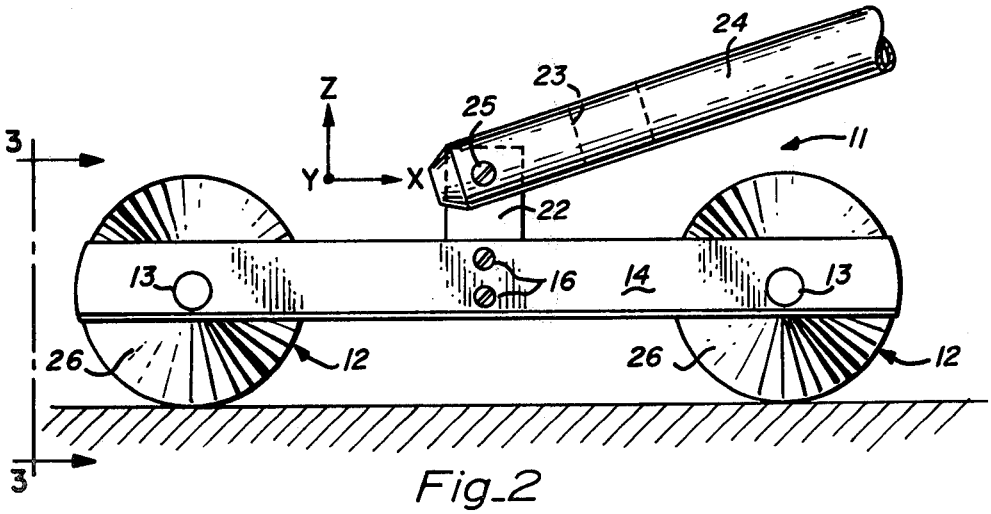
FIG. 2 is a side elevational view of the tool of FIG. 1 taken along line 2—2 in the direction of the arrows.

Referring now to FIGS. 1-4 there is shown the corner roller dry wall taping tool 11 incorporating features of the present invention. The corner roller taping tool 11 includes a pair of tandem roller wheels 12, as of nylon or Teflon mounted on respective axles 13 for rotation thereon. The axles 13 are mounted to and extend laterally across a pair of side frame plate members 14 at opposite ends thereof.

A spacer block structure 15 extends laterally between the frame members 14 centrally thereof. The spacer block 15 is secured to the frame members via a plurality of screws 16. The spacer block 15 includes a centrally recessed portion 17 and a Y-shaped yoke member 18 is disposed with opposite arm portions 19 straddling the spacer block 15 and pivotably secured thereto via the intermediary of a pivot pin 21 passing axially of the tool 11 through the spacer block 15 and through aligned bores in opposite arm portions 19 of the Y-shaped yoke 18.

The central leg portion 22 of the yoke 18 extends upwardly therefrom and is pinned to a longitudinally slotted end portion 23 of an elongated handle 24 via the intermediary of pivot pin 25. When the central leg 22 of the Y-shaped yoke 18 is aligned with the Z axis, the yoke is pivotable about the X axis on pin 21 and the handle 24 is pivotable on pin 25 about the Y axis.

The roller wheels 12 each include a tread portion 26 having a generally V-shaped radial cross-section with an included angle $\theta$ defined between the two opposite face portions 26. The included angle $\theta$ is close to 90°, i.e., within the range of 80° to 110°, for pressing the applied cement ladened tape into firm engagement with the side walls 28 of the corner seam 29 between two intersecting sheets of dry wall 31 and 32 (see FIG. 3). In a preferred embodiment, the included angle $\theta$ of one of the wheels is larger than 90°, as of 96°, and included angle of one of the other wheel is less than 90°, such as 84°. This variation in the included angle $\theta$ helps to accommodate imperfect right angle seams between intersecting sheets of dry wall 31. Also, the lateral spacing between the side frame members 14 and the axial extent of the individual roller wheels 12 is sufficient to permit substantial travelling of the roller wheels along the axis of revolution of the respective axles 13 in order to accommodate imperfections in the alignment of the seam 29.

In a typical example, the roller wheel 12 are 2.375 inches in diameter, and 1.50 inches in axial extent. The faces 26 are 1 inch wide and there is 0.189 inch play between the axial ends of the respective roller wheels 12 and the frame member 14. The roller wheels 12 are mounted with a separation in the X direction of 5 inches.

Figure 3:
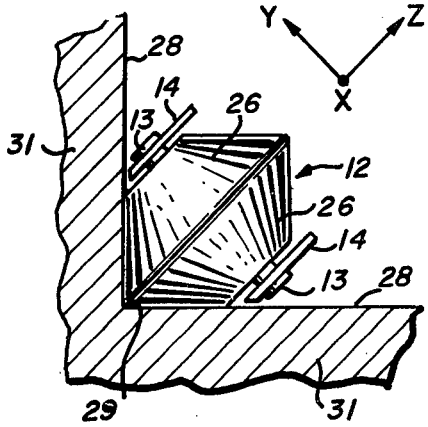
FIG. 3 is an end view of the tool of FIG. 2 taken along line 3—3 in the direction of the arrows and depicting the corner tool as used in a corner dry wall seam.
Figure 4:
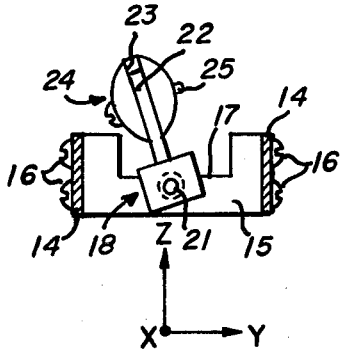
FIG. 4 is a sectional view of the structure of FIG. 1 taken along line 4—4 in the direction of the arrows.

In operation, the operator grasps the end of the handle 24 and places the roller wheels 12 in the seam 29, in the manner as shown in FIGS. 3. The operator then rolls the tool along the seam in one direction and then along the seam in the opposite direction, i.e. plus and minus X directions for pressing the tape into firm engagement with the wall portions 31 and for squeezing the excess cement out from under the tape to facilitate finishing of the taped corner seam by means of a conventional corner finishing tool. The pivotable coupling of the handle 24 to the frame 14 allows the operator to run the tool up and down a vertical seam 29 by pivoting the handle about pivot pin 25, i.e. about the Y axis. The pivotable coupling of the handle to the frame via pin 21 allows the operator to operate the tool from a position canted relative to the plane bisecting the right angle corner seam to be taped.

The advantage to the corner roller tool 11 of the present invention is that it is substantially less complicated than that of the prior art corner roller employing four separate cylindrical rollers. Therefore, the tool is less expensive to manufacture and easier to keep clean. In addition, the lateral play between the roller wheels 12 on the respective axles 13 permits the tool to accommodate imperfections in the alignment of the corner seam 29. Furthermore, the different included angles $\theta$ for the two wheels 12 allows compensation for imperfect right angle corners.

What is claimed is:

1. In a corner roller dry wall taping tool:

roller means for rolling dry wall tape into a corner seam, said roller means including a pair of corner roller wheels disposed for rotation about a pair of axes of rotation which are spaced apart such that one of said wheels tracks behind the other as said wheels roll along the corner seam being taped, each of said wheels having a tread portion of generally V-shaped radial cross-section with opposed faces and with the included angle between the opposed faces of said tread portions being between 80° and 110° for pressing the tape into firm engagement with the side walls at the corner seam.

2. The apparatus of claim 1 wherein the included angle between the opposed faces of said tread portions of one of said wheels is greater than that of the other wheel.

3. The apparatus of claim 1 wherein the included angle $\theta$ between the opposed faces of said tread portions of one of said wheels is greater than 90° and the included angle $\theta$ between the opposed faces of said tread protions of said other wheel is less than 90°.

4. The apparatus of claim 1 including, axle means coaxial with the axes of rotation of said wheel means, frame means for holding said axle means in spaced apart relation, elongated handle means to be grasped by the operator for manipulating the cornering wheels along the corner seam, pivot means for coupling said handle to said frame means and for pivoting of said handle about first and second pivot axes of revolution relative to said frame means, said first pivot axis of revolution being generally parallel to said axes of revolution of said wheel means, and said second pivot axis being parallel to the direction in which said wheels are spaced apart.

5. The apparatus of claim 1 wherein each of said wheels is free to travel in a direction along its respective axis of rotation relative to the other wheel to facilitate tracking of the wheels along imperfectly aligned corner seams.

* * * * *